US005802703A

United States Patent [19]

Totsuka et al.

[11] Patent Number: 5,802,703

[45] Date of Patent: Sep. 8, 1998

[54] METHOD OF FORMING A CHAIN OF FUSE-LINKS

[75] Inventors: Mitsuhiko Totsuka; Hisashi Hanazaki, both of Shizuoka, Japan

[73] Assignee: Yazaki Corporation, Tokyo, Japan

[21] Appl. No.: 831,941

[22] Filed: Apr. 2, 1997

Related U.S. Application Data

[62] Division of Ser. No. 630,767, Apr. 10, 1996, Pat. No. 5,661,448.

[30] Foreign Application Priority Data

Apr. 18, 1995 [JP] Japan ..... 7-092228

[51] Int. Cl.[6] ..... H01H 69/02; H01R 43/16

[52] U.S. Cl. ..... 29/623; 29/874; 206/713

[58] Field of Search ..... 29/623, 874; 206/713, 206/820; 337/160, 166, 260, 296

[56] References Cited

U.S. PATENT DOCUMENTS 4,027,521 6/1977 McKee et al. ..... 29/874
4,944,084 7/1990 Horibe .
4,958,426 9/1990 Endo .
5,262,751 11/1993 Kudo .
5,488,346 1/1996 Kondo .
5,528,213 6/1996 Kondo .
5,546,066 8/1996 Kondo .

*Primary Examiner*—P. W. Echols
*Attorney, Agent, or Firm*—Armstrong, Westerman, Hattori, McLeland & Naughton

[57] ABSTRACT

A method of forming a chain of fuse-links made from an electrically conductive metal plate. Each fuse-link P4 has an arc-shaped fusing portion 1 and a couple of terminal portions 4, 4 constituting a pair of wing-shaped members connected to each end of the arc-shaped fusing portion 1. A carrier strap 9 has a plurality of vertical connecting pieces 8 each positioned at fixed intervals for retaining the plurality of fuse-links P4. Each of a plurality of interconnection pieces 7' is connected to the vertical connecting piece 8 at one end and connected to a side edge of specific side one of the couple of terminal portions at the other end. The other end of the interconnection piece 7' is bent so that the end edges of the couple of terminal portions 4, 4 rise above the carrier strap 9.

2 Claims, 4 Drawing Sheets

METHOD OF FORMING A CHAIN OF FUSE-LINKS

This application is a divisional application of application Ser. No. 08/630,767 filed on Apr. 10, 1996 now U.S. Pat. No. 5,661,448.

BACKGROUND OF THE INVENTION

1. Field of the Invention

This invention relates to a chain of fuse-links each of which composes a fuse assembly used for large electric current and to a forming method of the same.

2. Description of the Prior Art

A fuse assembly named a fusible link and used for large electric current has a structure shown in FIGS. 5 and 6.

In the Figures, designated 21 is a fuse-link that includes an arc-shaped fusing portion 22 provided with a couple of terminal portions 23, 23 at both ends thereof, the terminal portions 23, 23 being disposed to constitute a pair of wing-shaped members. Further, on the top of the fusing portion 22 a low-melting alloy piece 25 is fixed by a pair of crimping members 24, 24.

The fuse-link 21 with a spacer 26 is received in a housing 27 made of a synthetic resin and covered by a covering plate 28 to compose a fuse assembly 29 used for large electric current.

In FIGS. 7 to 9, there is shown a conventional forming method of the fuse-link 21. First, as shown in FIG. 7, in an initial process of a first production line, a plate material made of an electrically conductive metal such as copper and beryllium-copper alloy is punched to obtain a primary formed product P1. The primary formed product P1 has a narrow-strip-shaped fusing portion 22 provided with a crimping member 24 at both sides thereof. Further, a couple of aligned terminal portions 23, 23 with a hole 23*a* are respectively positioned at each end of the fusing portion 22 by way of a retaining plate 30. Each terminal portion 23 is connected to a carrier strap 32 (continuous band plate) by a connection piece 31 so that the products P1 are continuously connected. In the next step, at the middle portion of the fusing portion 22 there is mounted a low-melting alloy piece 25 to be fixed by bending the crimping members 24, 24 so as to obtain a secondary formed product P2.

Then, a large number of the secondary formed products P2 continuously connected by the carrier strap 32 disposed at both sides thereof are wound in a reel 33 to be stored as shown in FIG. 8.

Next, before assembling the fuse assembly 29 for large electric current, a second production line, as shown in FIGS. 9A and 9B, cuts the connection piece 31 to separate the fuse-links from the carrier strap 32. Then, both the retaining plates 30, 30 are bent into arc shape so that the low-melting alloy piece 25 is positioned in the top position to obtain a finished product of a fuse-link 21.

The prior art for forming fuse-links 21, as shown in FIGS. 7 to 9, has the two separate production process lines to protect the fusing portions 22, which brings a high production cost and has a disadvantage that it needs two steps for quality control and also for inventory control.

SUMMARY OF THE INVENTION

In view of the above-mentioned drawback, an object of the present invention is to provide a chain of fuse-links and a forming method of the same, which enables to accomplish a low production cost and to achieve a consistent quality control and a simplified inventory control.

For achieving the above-mentioned object, in a first aspect of the invention, a chain of fuse-links made from an electrically con ductive metal plate includes:

a plurality of fuse-links each having an arc-shaped fusing portion and a couple of terminal portions constituting a pair of wing-shaped members connected to each end of the arc-shaped fusing portion;

a carrier strap having a plurality of vertical connecting pieces each positioned at fixed intervals for retaining the plurality of fuse-links;

a plurality of interconnection pieces each connected to the vertical connecting piece at one end and connected to a side edge of specific side one of the couple of terminal portions at the other end; and wherein the other end of the interconnection piece is bent so that the end edges of the couple of terminal portions rise above the carrier strap.

In a second aspect of the invention, a chain of fuse-links made from an electrically conductive metal plate includes:

a plurality of fuse-links each having an arc-shaped fusing portion and a couple of terminal portions constituting a pair of wing-shaped members connected to each end of the arc-shaped fusing portion;

a couple of L-shaped spacing members each positioned in a diagonal position to each other and rising from each of a couple of interconnection pieces connected to a side edge each of the couple of the terminal portions; and wherein specific side one of the couple of the terminal portions is connected to a downstream adjacent terminal portion by way of the specific side one of the couple of interconnection pieces and the spacing members rise not less than the height of the fusing portion.

In a third aspect of the invention, a method for forming a chain of fuse-links includes the steps of:

stamping a narrow-strip-shaped fusing portion, a couple of terminal portions each connected to each end of the fusing portion by way of a rising portion and a retaining plate, a couple of interconnection pieces each connecting each of the terminal portions with a downstream adjacent terminal portion, and a part of a carrier strap connected to specific side one of the couple of interconnection pieces by way of a vertical connecting piece from an electrically conductive plate material;

cutting off the other one of the couple of interconnection pieces, cutting one end of the specific side interconnection piece so as to separate the corresponding terminal portion from the downstream adjacent terminal portion, and bending each of the rising portions so that the fusing portion rises in arc shape; and upwardly bending the other end of the specific side interconnection piece so that the end edges of the terminal portions perpendicularly rise to the carrier strap.

In a forth aspect of the invention, a method of forming a chain of fuse-links includes the steps of:

stamping a narrow-strip-shaped fusing portion, a couple of terminal portions each connected to each end of the fusing portion by way of a rising portion and a retaining plate, a couple of interconnection pieces each connecting each of the terminal portions with a downstream adjacent terminal portion, and a couple of spacing members each connected to each of the interconnection piece in parallel to each of the terminal portions from an electrically conductive metal plate; and bending each of the rising portions so that the fusing portion rises in arc shape and folding the spacing members in L-shape so as to rise not less than the height of the fusing portion.

Next, operation and effects of the present invention will be discussed. According to the first aspect of the invention, each fuse-link rises by the interconnection piece and the vertical connecting piece in such a way that a plain including the plate surface of the terminal portion is directed in a direction to cross the carrier strap. Thereby, when the chain of fuse-links is wound in a reel in the direction in which the carrier strap is extending, the fusing portion is easily prevented from making contact with other fuse-links not to be damaged and the fuse-links wound in the reel are easily handled.

The chain of fuse-links according to the third aspect of the invention, is continuously completely formed in a single production line. Moreover, completed products, as mentioned above, can be easily wound in a reel. Thereby, it enables a reduction in production cost, easier quality control and simplified inventory control.

According to the second aspect of the invention, one of the terminal portions is connected to an adjacent terminal portion by way of an interconnection piece and a couple of the spacing members positioned at the side of the terminal portions rise not less than the height of the fusing portion. Thereby, when the chain of fuse links is wound in a reel in the direction that the carrier strap is extending, the fusing portion, as similar to the first aspect of the invention, is prevented from making contact with other fuse-links not to be damaged and the fuse-links wound in the reel are easily handled.

The chain of fuse-links, as mentioned in the second aspect of the invention, is continuously completely formed in a single production line. Moreover, completed products, as mentioned above, can be directly wound in a reel. Thereby, it enables a reduction in production cost, easier quality control and simplified inventory control.

DETAILED DESCRIPTION OF PREFERRED EMBODIMENTS

Figure 1:
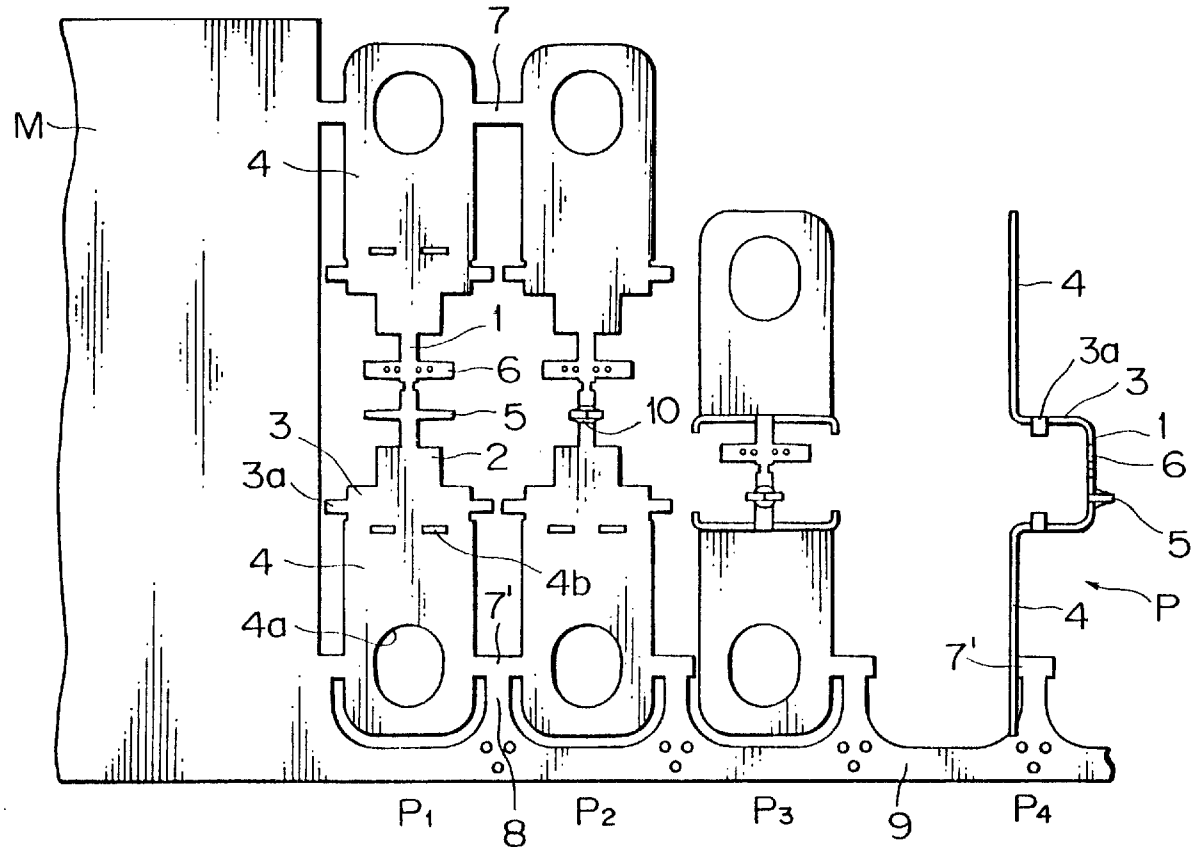
FIG. 1 is a plan showing a forming method of a chain of fuse-links of an embodiment regarding the present invention.
Figure 2:
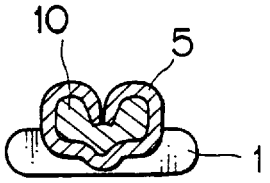
FIG. 2 is a longitudinal sectional view of a portion including a low-melting alloy piece 10 in FIG. 1.

In FIGS. 1 and 2, designated P is one fuse-link of a chain of fuse-links. The fuse-links P can be consistently, continuously formed from a plate material M in one production line by stamping and bending process and can be wound in a reel so as to be directly stored.

Firstly, in the first forming step, a primary product P1 is formed from a plate material M by stamping or punching process. The primary product P1 includes a narrow-strip-shaped fusing portion 1 and a couple of terminal portions 4, 4 positioned symmetrically from the center of the product by way of a retaining plate 2 and a rising portion 3. The terminal portion 4 is provided with a hole 4*a*.

Figure 6:
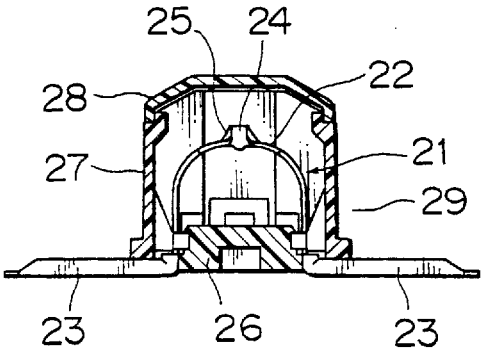
FIG. 6 PRIOR ART
FIG. 6 is a longitudinal sectional view of FIG. 5.
Figure 7:
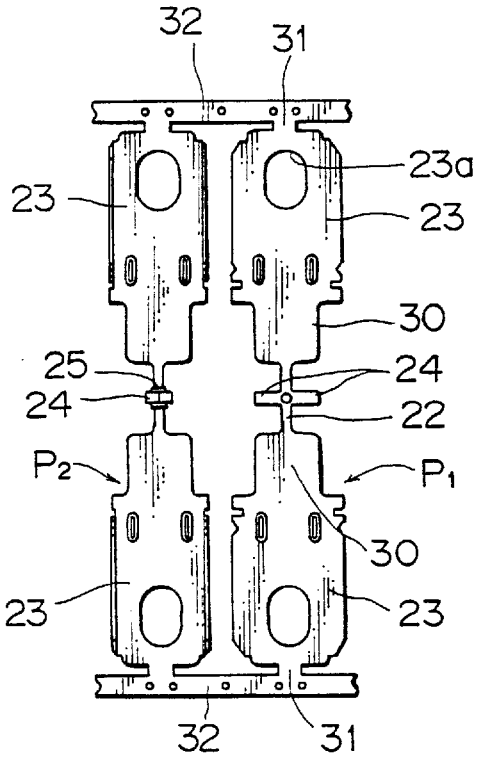
FIG. 7 PRIOR ART
FIG. 7 is a plan showing a chain of fuse-links for large electric current in FIG. 5.

The fusing portion 1 has a pair of crimping members 5, 5 outwardly extending from each side of the portion 1 at a position biased toward one end and a couple of heat radiation plates 6, 6 outwardly extending from each side of the portion 1 at a position biased toward the other end. The plate 6 has a wider breadth than the crimping member 5. Further, the rising portion 3 has a small piece 3*a* at each side thereof to position the spacer 26 illustrated in FIG. 6. Moreover, each of the terminal portions 4, 4 positioned each outside of the fusing portion 1 is connected to an adjacent terminal portion 4 at each side edge thereof by way of an interconnection piece 7 or 7'. A lower interconnection piece 7' in FIG. 1 is connected to a carrier strap 9 by way of a vertical connecting piece 8. The vertical connecting piece 8 extends from the carrier strap 9, for example, at a right angle as shown in the FIG. 1.

In the second forming step, a secondary formed product P2 is obtained by cutting and bending processes. In the secondary product P2, a low-melting alloy piece 10 is fixed on the fusing portion 1 by the crimping members 5, 5 and each of the small pieces 3*a* extending from each side end of upper and lower rising portions 3, 3 is downwardly bent so as to make a right angle.

In the third forming step, a tertiary formed product P3 is formed by bending process. In the tertiary product P3, the upper interconnection piece 7 is cut off so that the adjacent terminal portions 4, 4 are separated from each other. Further, one end of the interconnection piece 7' positioned toward the secondary product P2 is cut so that the terminal portion 4 of the secondary product P2 is separated from the tertiary product P3. Moreover, the rising portions 3, 3 positioned at each side of the fusing portion 1 are bent upwardly to be vertical to the terminal portions 4, 4 at reed or weakened portions 4*b*, 4*b* so that the fusing portion 1 is displaced or rises up substantially in the shape or form of an arch between the pair of terminal portions. The tertiary product P3 is structurally completed as a fuse-link for large electric current.

In the forth forming step, the product P3 is upwardly turned by bending the nearer end portion of the interconnection piece 7' to obtain a finished formed product P4 in which a plane including the plate surface of the terminal portion 4 is substantially normal orthogonal to the carrier strap 9. As a result, a chain of fuse-links P is obtained.

The chain of fuse-links P includes fuse-links (finished product P4) connected to the carrier strap 9 at fixed intervals by the vertical connecting pieces 8. The fusing portion 1 including the low-melting alloy piece 10 in the finished product P4 rises orthogonally to the carrier strap 9.

Figure 8:
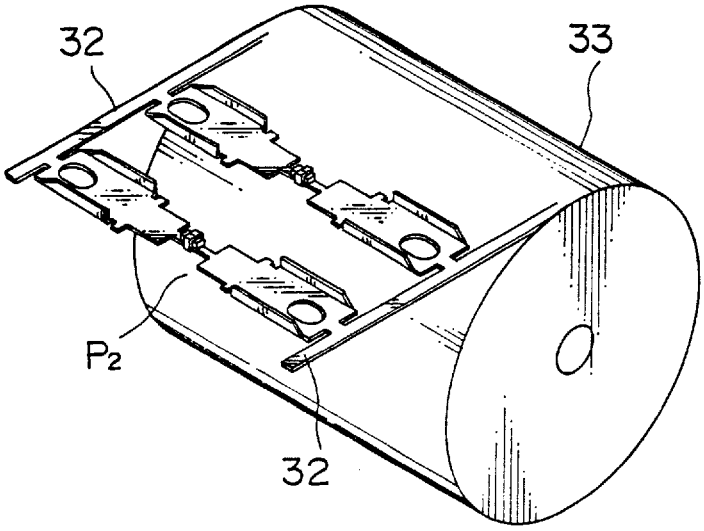
FIG. 8 PRIOR ART
FIG. 8 is an illustration showing a reel for winding the chain of fuse-links in FIG. 7.
Figure 9A:
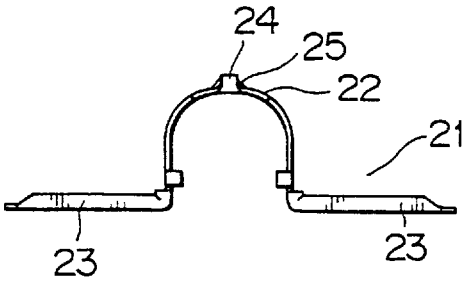
FIG. 9 A PRIOR ART
FIG. 9A is the front view of a finished fuse-link related to FIG. 8
Figure 9B:
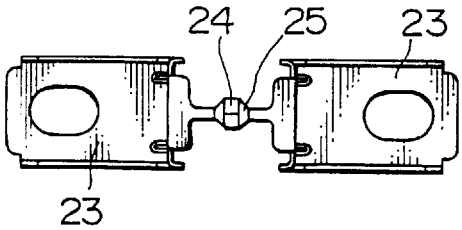
FIG. 9 B PRIOR ART
FIG. 9B is a plan of the same.

Therefore, the chain of fuse-links P with the carrier strap 9 can be easily wound in a reel in such way as shown in FIG. 8. Further, when the links are wound, the fusing portion 1 including the low- melting alloy piece 10 and its crimping members 5, 5 are prevented from making contact with each other so as not to be damaged.

Figure 3:
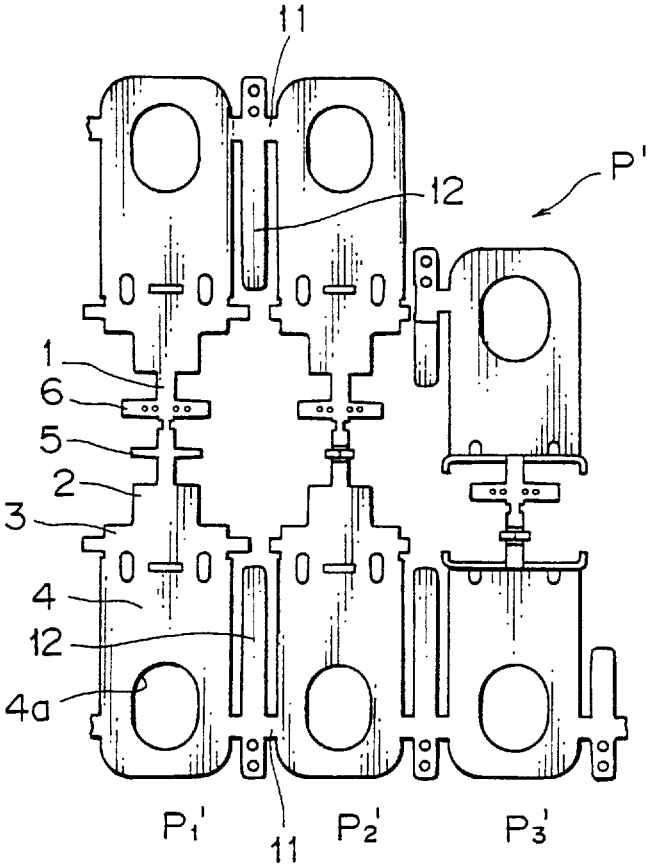
FIG. 3 is a plan showing a forming method of a chain of fuse-links of another embodiment regarding the present invention.
Figure 4:
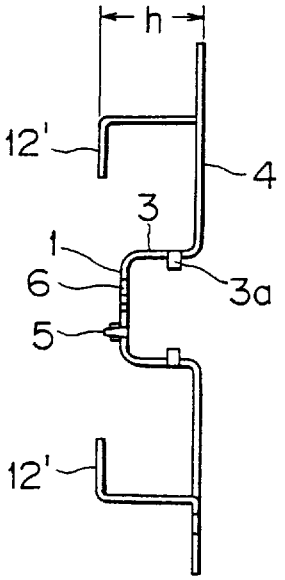
FIG. 4 is a right side view of the fuse-link in FIG. 3.
Figure 5:
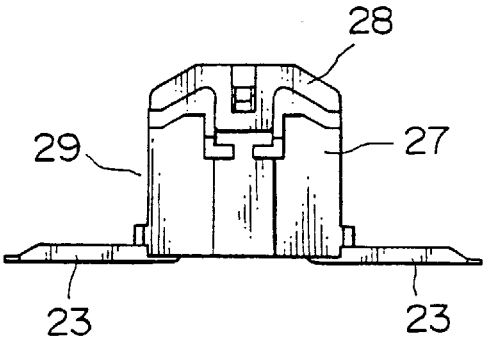
FIG. 5 PRIOR ART
FIG. 5 is the front view of a conventional fuse-link for large electric current.

In FIGS. 3 and 4, there is shown another embodiment of the present invention, in which the carrier strap 9 of the aforementioned embodiment is omitted so that forming process is further simplified.

Firstly, in the first forming step, a primary product P1' is formed from a plate material M by stamping process. This primary product P1' includes a narrow-strip-shaped fusing portion 1 having a pair of crimping members 5, 5 and a couple of heat radiation plates 6, 6 and a couple of terminal portions 4, 4 disposed symmetrically to the center of the product by way of a retaining plate 2 and a rising portion 3. The upper and lower terminal portions 4, 4 are connected to a respective adjacent terminal portion 4 by way of an interconnection piece 11 as well as the aforementioned primary product P1. Each interconnection piece 11 has a spacing member 12 positioned parallel to the terminal portion 4. The spacing member 12 is a little longer than the total length of the rising portion 3 and the retainer 2 so that, when folded in L-shape, the spacing member 12 is not less than the fusing portion 1 in height above the terminal portion 4 as shown in FIG. 4.

In the second forming step, similarly to the aforementioned method, a small piece 3*a* at each side of the rising portion 3 is bent and a low-melting alloy piece 10 is fixed on the fusing portion 1 by the crimping members 5, 5 to obtain a secondary formed product P2'.

In the third forming step, the secondary formed product P2' is separated from a downstream adjacent terminal portion 4 by cutting the upper interconnection piece 11. Then, the fusing portion is formed in arc shape by bending process in the same way as described in the tertiary formed product P3. Further, each of the upper and lower spacing members 12, 12 is bent in L-shape above the terminal portion 4 so that the height h of the spacing member 12 is not less than the fusing portion 1 and the crimped portion of the low-melting alloy piece 10.

Thus obtained chain of fuse-links P' is composed of the tertiary products P3' each of which has a couple of the L-shaped spacing members 12 that are positioned at the sides of both the terminal portions 4, 4 so as to be diagonal to each other. As the spacing member 12 rises not less than the height of the fusing portion 1, the fuse-links P' can be wound in a reel along a surface of the terminal portion 4 with the spacing members 12 between each layer. Accordingly, when the links are wound, the fusing portions 1 are prevented from making contact with each other to prevent damage as well as, in the aforementioned embodiment.

What is claimed is:

1. A method of forming a chain of fuse links comprising the steps of:

stamping an electrically conductive plate material to provide a narrow strip-shaped fusing portion, a pair of terminal portions with one end of each terminal portion connected to one of opposite ends of said fusing portion by a rising portion and a retaining plate, a pair of interconnection pieces with each interconnection piece connecting one of said terminal portions with an adjacent terminal portion, a carrier strap, and a connecting piece connecting one of said interconnection pieces with a part of said carrier strap, cutting off the other one of said interconnection pieces, cutting one end of said one interconnection piece to separate the corresponding terminal portion from said connecting piece and adjacent terminal portion, bending each of said rising portions to displace said fusing portion from said terminal portion, and bending the other end of said one interconnection piece adjacent said connecting piece to displace said pair of terminal portions to a plane substantially normal to said carrier strap.

2. The method of forming a chain of fuse links of claim 1 wherein said rising portions are bent with said fusing portion displaced substantially in the form of an arch between said pair of terminal portions.

* * * * *